US007802787B2

(12) United States Patent
Miwa

(10) Patent No.: US 7,802,787 B2
(45) Date of Patent: Sep. 28, 2010

(54) SHEET DISCHARGING DEVICE AND IMAGE FORMING APPARATUS

(75) Inventor: Atsushi Miwa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/163,268

(22) Filed: Jun. 27, 2008

(65) Prior Publication Data

US 2009/0001651 A1 Jan. 1, 2009

(30) Foreign Application Priority Data

Jun. 28, 2007 (JP) ..... 2007-170116

(51) Int. Cl.
*B65H 29/70* (2006.01)

(52) U.S. Cl. ..... 271/188; 271/184; 271/209

(58) Field of Classification Search ..... 271/209, 271/184, 188
See application file for complete search history.

(56) References Cited

U.S. PATENT DOCUMENTS

| | | | | |
|---|---|---|---|---|
| 5,996,995 | A * | 12/1999 | Kim et al. | 271/303 |
| 6,179,287 | B1 * | 1/2001 | Watanabe et al. | 271/215 |
| RE37,157 | E * | 5/2001 | Ikeda et al. | 399/124 |
| 6,375,181 | B1 * | 4/2002 | Kawano et al. | 270/58.12 |
| 6,503,011 | B2 * | 1/2003 | Kono | 400/646 |
| 6,701,841 | B2 * | 3/2004 | Tsurumaki | 101/419 |
| 6,983,122 | B2 * | 1/2006 | Hayamizu et al. | 399/405 |
| 2003/0160385 | A1 | 8/2003 | Furusawa | |
| 2005/0206069 | A1 * | 9/2005 | Yamamoto | 271/117 |
| 2005/0236764 | A1 * | 10/2005 | Saeki et al. | 271/293 |
| 2006/0165455 | A1 | 7/2006 | Kajita | |
| 2007/0045948 | A1 * | 3/2007 | Hanada et al. | 271/288 |
| 2009/0295083 | A1 * | 12/2009 | Kitan | 271/306 |

FOREIGN PATENT DOCUMENTS

| | | | |
|---|---|---|---|
| JP | 55-136739 | | 9/1980 |
| JP | 63074865 A | * | 4/1988 |
| JP | 05-058527 | | 3/1993 |
| JP | 08-040621 | | 2/1996 |
| JP | 08-127453 | * | 5/1996 |
| JP | 09-077339 | | 3/1997 |
| JP | 09-188458 | | 7/1997 |
| JP | 09-202506 | | 8/1997 |
| JP | 11-292387 | | 10/1999 |

(Continued)

*Primary Examiner*—Patrick Mackey
*Assistant Examiner*—Prasad V Gokhale
(74) *Attorney, Agent, or Firm*—Banner & Witcoff, Ltd

(57) ABSTRACT

A sheet discharging device and image forming apparatus are provided. The sheet discharging device includes a sheet discharging port; a sheet discharging tray which is provided correspondingly to the sheet discharging port, a sheet discharged from the sheet discharging port being stacked on the sheet discharging tray; and a plurality of sheet lifting members provided so as to be moveable between a retraction position and a protrusion position; wherein when a leading end portion of the sheet contacts with the sheet lifting members, the sheet lifting members move from the retraction position to the protrusion position, the sheet lifting members stay at the protrusion position and lift up the sheet while the sheet is discharged from the sheet discharging port to the sheet discharge tray, and the sheet lifting members return to the retraction position when the sheet has been discharged from the sheet discharging port.

12 Claims, 10 Drawing Sheets

FOREIGN PATENT DOCUMENTS

| | | |
|---|---|---|
| JP | 2001-031312 | 2/2001 |
| JP | 2002-154726 | 5/2002 |
| JP | 2003-252511 | 9/2003 |
| JP | 2004-284773 | 10/2004 |
| JP | 2004-323131 | 11/2004 |
| JP | 2005-239424 | 9/2005 |
| JP | 2006-206246 | 8/2006 |

* cited by examiner

SHEET DISCHARGING DEVICE AND IMAGE FORMING APPARATUS

CROSS REFERENCE TO RELATED APPLICATION

The present application claims priority from Japanese Patent Application No. 2007-170116, which was filed on Jun. 28, 2007, the disclosure of which is herein incorporated by reference in its entirety.

TECHNICAL FIELD

Apparatuses and devices consistent with the present invention relate to a sheet discharging, and more particularly, to a sheet discharging device for discharging a sheet and an image forming apparatus for forming an image on the sheet.

BACKGROUND

Japanese unexamined patent application publication No. JP-A-2004-323131 describes a related art sheet discharging device. The related art sheet discharging device is configured such that sheets discharged from a main body to a sheet discharging tray can be stacked appropriately in order of discharge. However, in a case where the main body is a part of an image forming apparatus which forms an image on the sheet, for example, by electro-photography, the sheet is subjected to a thermal fixing process before being discharged, and thus the discharged sheet is often curled due to the influence of heat generated in the thermal fixing process. Accordingly, the related art sheet discharging device has a disadvantage in that it is often difficult to stack such curled sheets on one another orderly in the sheet discharging tray.

FIG. 10 shows a related art sheet discharging device 22. Each conveyed sheet 7 is discharged from a discharge port 34 to a sheet discharging tray 16 by a discharge roller (not shown). Two pressing units 66 are provided in the discharge port 34 so that the pressing units 66 press the sheet 7 discharged to the sheet discharging tray 16. The two pressing units 66 are provided substantially at opposite end portions of the discharge port 34, respectively, in the width direction of the sheet. In each pressing unit 66, a pressing member 68 is provided 66 so that the pressing member 68 can rotate around a pivot 76. The pressing members 68 press substantially opposite end portions in the width direction of the sheet 7 discharged from the discharge port 34 to the sheet discharging tray 16. Since the sheet 7 is apt to be curled at its opposite edge portions, the pressing members 66 are disposed at positions corresponding to the opposite edge portions of the sheet that is conveyed, respectively. Accordingly, the curl of the sheet 7 is corrected.

However, the related art sheet discharging device still has some disadvantages. For example, each of the pressing members 68 has one end connected to the pivot 76 so that the pressing member 68 can rotate around the pivot 76. The uprise angle and weight of each pressing member 68 are set to keep balance between curl correction and conveyance resistance, so that the pressing member 68 presses each discharged sheet 7 with its own weight. However, if an extensively curled sheet 7 is discharged, the pressing members 68 cannot correct opposite edge portions of the sheet 7 because the pressing members 68 rotate counterclockwise and the weight of the pressing member 68 is not enough to correct the curl. As a result, the leading end portion of the currently discharged sheet 7 interferes with and presses against a trailing end of a previously discharged sheet 7 to thereby disorder the sheets 7 stacked in the sheet discharging tray 16.

SUMMARY

Accordingly, it is an aspect of the present invention to provide a sheet discharging device which can stack sheets orderly on a sheet discharging unit even when a curled sheet is discharged, and an image forming apparatus forming an image on each sheet.

Exemplary embodiments of the present invention address the above disadvantages and other disadvantages not described above. However, the present invention is not required to overcome the disadvantages described above, and thus, an exemplary embodiment of the present invention may not overcome any of the problems described above.

According to an illustrative aspect of the present invention, there is provided a sheet discharging device comprising a sheet discharging port from which a sheet is discharged; a sheet discharging tray which is provided correspondingly to the sheet discharging port, the sheet discharged from the sheet discharging port being stacked on the sheet discharging tray; and a plurality of sheet lifting members provided so as to be moveable between a retraction position in which the sheet lifting members are located in the sheet discharging port and a protrusion position in which the sheet lifting members protrude from the sheet discharging port toward the sheet discharging tray; wherein when a leading end portion of the sheet contacts with the sheet lifting members, the sheet lifting members move from the retraction position to the protrusion position, the sheet lifting members stay at the protrusion position and lift up the sheet while the sheet is discharged from the sheet discharging port to the sheet discharge tray, and the sheet lifting members return to the retraction position when the sheet has been discharged from the sheet discharging port.

According to another illustrative aspect of the present invention, there is provided an image forming apparatus comprising an image forming unit that forms an image on a sheet; a sheet discharging device comprising a sheet discharging port from which the sheet is discharged; a sheet discharging tray which is provided correspondingly to the sheet discharging port, the sheet discharged from the sheet discharging port being stacked on the sheet discharging tray; and a plurality of sheet lifting members provided so as to be moveable between a retraction position in which the sheet lifting members are located in the sheet discharging port and a protrusion position in which the sheet lifting members protrude from the sheet discharging port toward the sheet discharging tray; wherein when a leading end portion of the sheet contacts with the sheet lifting members, the sheet lifting members move from the retraction position to the protrusion position, the sheet lifting members stay at the protrusion position and lift up the sheet while the sheet is discharged from the sheet discharging port to the sheet discharge tray, and the sheet lifting members return to the retraction position when the sheet has been discharged from the sheet discharging port.

According to another illustrative aspect of the present invention, there is provided an image forming apparatus comprising an image forming unit that forms an image on a sheet; a plurality of discharge rollers which discharge the sheet from an interior of the image forming apparatus; a sheet discharging tray which receives the sheet from the discharge rollers; and at least one sheet lifting member which deflects the sheet which is discharged by the discharge rollers upward with respect to a discharge path of the sheet.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

First Exemplary Embodiment

A first exemplary embodiment of the present invention will be described hereinafter with reference to FIGS. 1 to 6.

Figure 1:
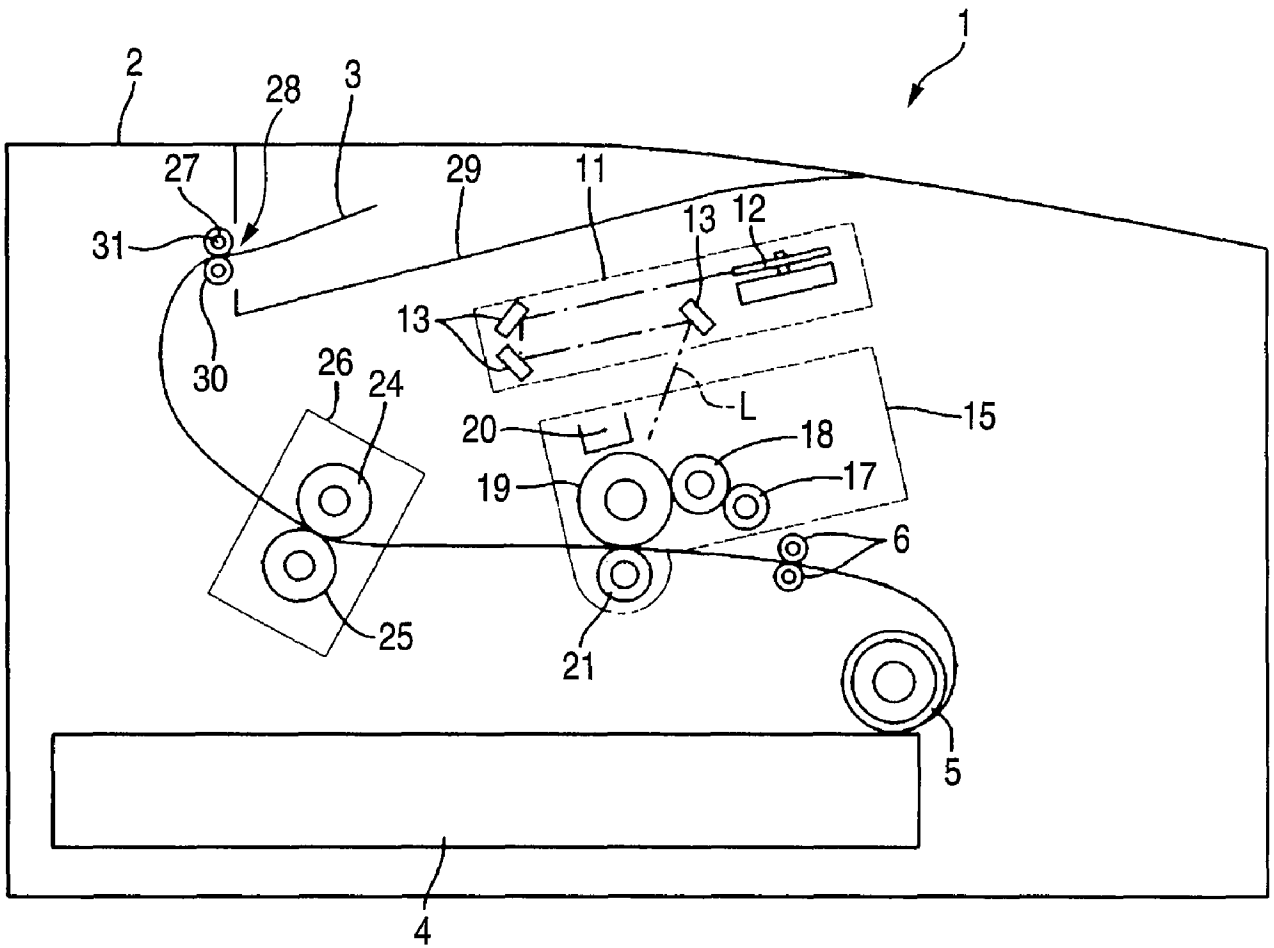
FIG. 1 is a schematic sectional view of an image forming apparatus according to a first exemplary embodiment of the present invention.
Figure 2:
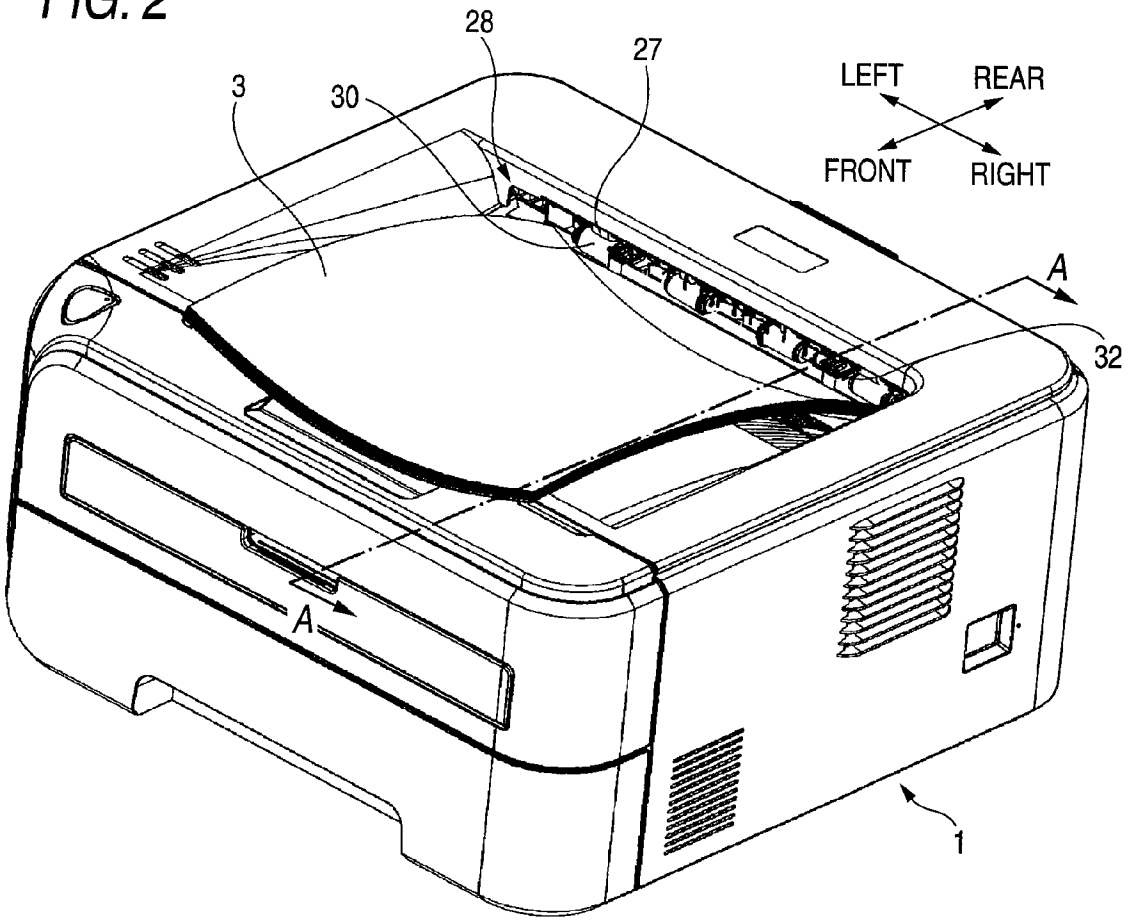
FIG. 2 is a perspective view of the image forming apparatus according to the first exemplary embodiment.

FIG. 1 is a side sectional view showing a schematic configuration of an image forming apparatus according to an exemplary embodiment of the invention. In this exemplary embodiment, the image forming apparatus is embodied in the form of a laser printer 1. The right side and the left side in FIG. 1 are regarded as front side and rear side of the laser printer 1, respectively. FIG. 2 is a perspective view of the laser printer 1 and shows a state in which sheets 3 have been discharged. The oblique left lower direction, the oblique right upper direction, the oblique right lower direction and the oblique left upper direction in FIG. 2 are regarded as front, rear, right and left of the laser printer 1, respectively.

The laser printer 1 is provided with a body casing 2 substantially shaped like a box. A sheet feeding tray 4 in which sheets 3 for forming images thereon are stacked on one another is disposed in a bottom portion of the body casing 2 so that the sheet feeding tray 4 can be pulled out to the front from the body casing 2. A feed roller 5 is provided on a front end of the sheet feeding tray 4. A sheet 3 which is the top of the sheets stacked in the sheet feeding tray 4 is fed out to a pair of registration rollers 6 in accordance with rotation of the feed roller 5. The registration rollers 6 are provided above a rear side of the feed roller 5.

A scanner unit 11 as an exposure unit is provided above the body casing 2. In the scanner unit 11, laser light L emitted from a laser emitting unit (not shown) is irradiated on the surface of a photosensitive drum 19 through a polygon mirror 12, reflecting mirrors 13 and a lens (not shown).

A process cartridge 15 is disposed in the body casing 2 so as to be located below the scanner unit 11 and is provided so as to be attachable and detachable. The process cartridge 15 includes a toner chamber (not shown) in which toner as a developing agent is contained; a feed roller 17; a developing roller 18 as a developing unit; the photosensitive drum 19 as an image carrier; a scorotron type charger unit 20; and a transfer roller 21 as a transfer unit.

Toner released from the toner chamber is supplied to the developing roller 18 in accordance with rotation of the feed roller 17. After the surface of the photosensitive drum 19 is electrostatically charged with positive electricity uniformly by the scorotron type charger unit 20 in accordance with rotation of the feed roller 17, the surface of the photosensitive drum 19 is exposed to laser light L emitted from the scanner unit 11, so that an electrostatic latent image corresponding to an image to be formed on the sheet 3 is formed on the surface of the photosensitive drum 19. Then, toner on the developing roller 18 is supplied to the surface of the photosensitive drum 19 in accordance with rotation of the developing roller 18, so that the electrostatic latent image is visualized to a visible toner image. Then, the toner image carried on the surface of the photosensitive drum 19 is transferred onto the sheet 3 by a transfer bias voltage applied to the transfer roller 21 while the sheet 3 passes between the photosensitive drum 19 and the transfer roller 21.

A fixing unit 26 including a heating roller 24 and a pressing roller 25 is provided at the rear of the process cartridge 15. In the fixing unit 26, the toner image transferred onto the sheet 3 is thermally fixed on a surface of the sheet 3. The sheet 3 with the thermally fixed toner image is conveyed to driving rollers 27 and driven rollers 30 provided above the body casing 2. The driving rollers 27 are driven around a rotary shaft 31 whereas the driven rollers 30 are driven by the driving rollers 27 while contacting with the driving rollers 27. The driving rollers 27 and the driven rollers 30 comprise a sheet discharging port 28. The sheet 3 is discharged on to a discharge tray 29 in accordance with rotation of the driving rollers 27 and the driven rollers 30. The discharge tray 29 is provided in an upper surface of the body casing 2. Then, the sheet 3 is discharged to the discharge tray 29 while contacting with sheet lifting members 32 (see FIG. 2). The sheet lifting members 32 in FIG. 2 are made to contact with the sheet 3 being discharged (not shown), so that the sheet lifting members 32 are located so as to protrude frontward. Details of each sheet lifting member 32 will be described below.

Figure 3:
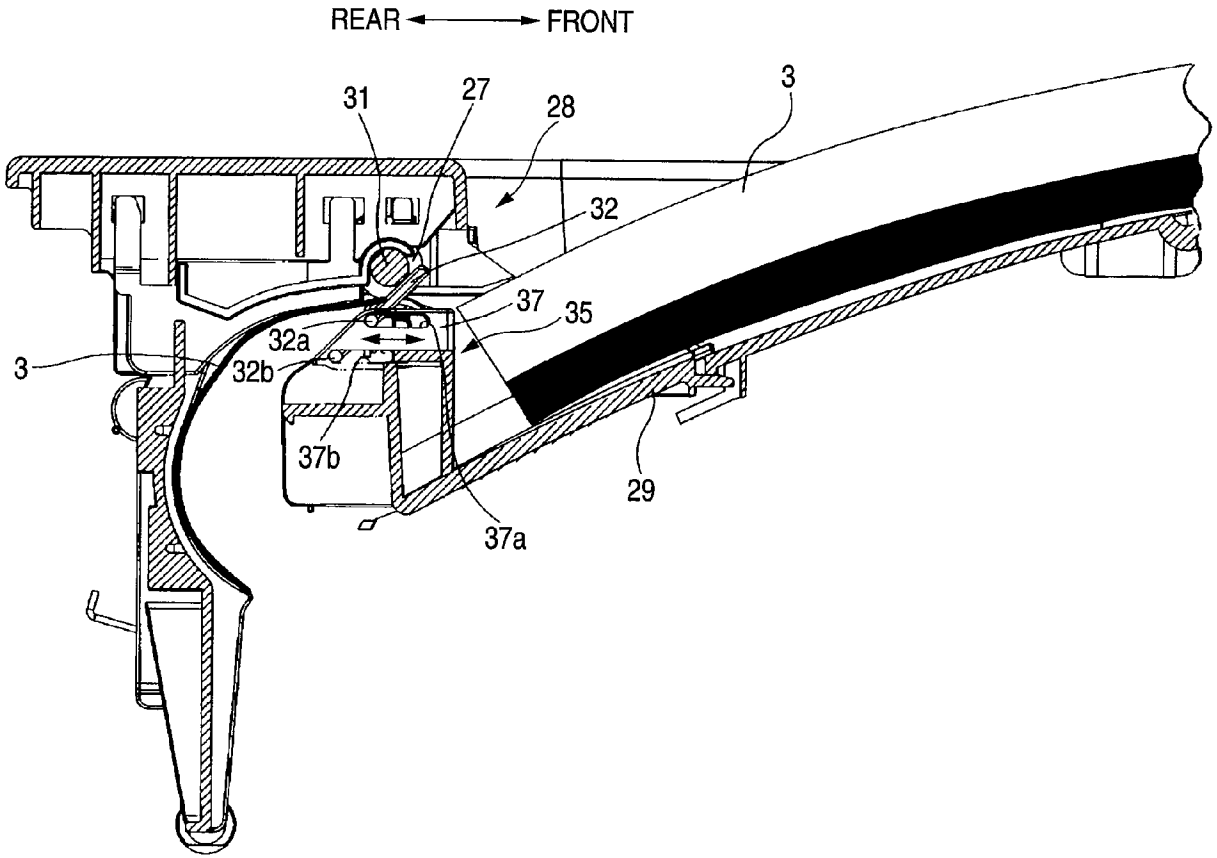
FIG. 3 is a view showing a state in which a sheet lifting member is disposed in a retraction position according to the first exemplary embodiment.
Figure 4:
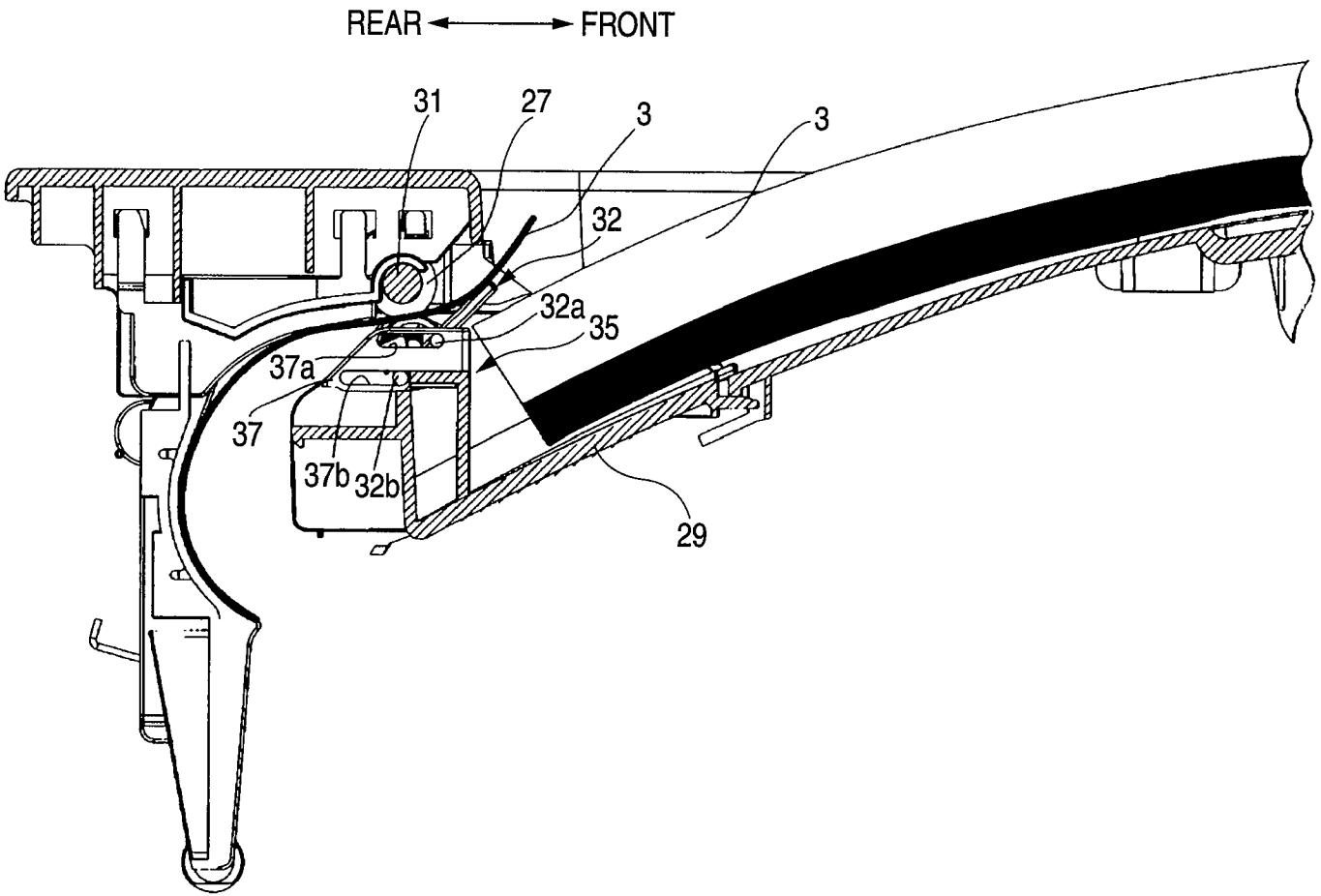
FIG. 4 is a view showing a state in which the sheet lifting member is disposed in a protrusion position according to the first exemplary embodiment.
Figure 5:
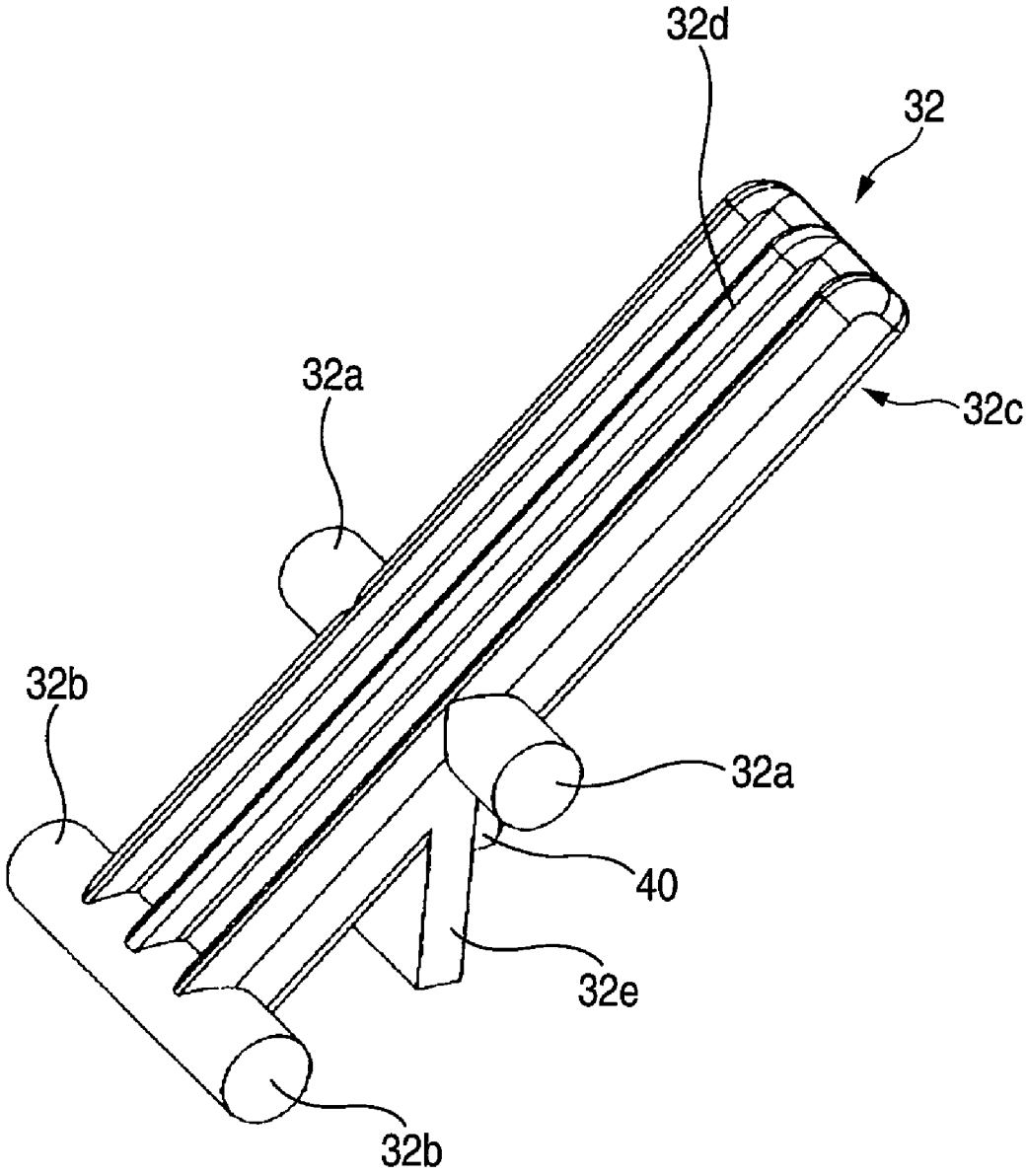
FIG. 5 is an enlarged perspective view of the sheet lifting member according to the first exemplary embodiment.
Figure 6:
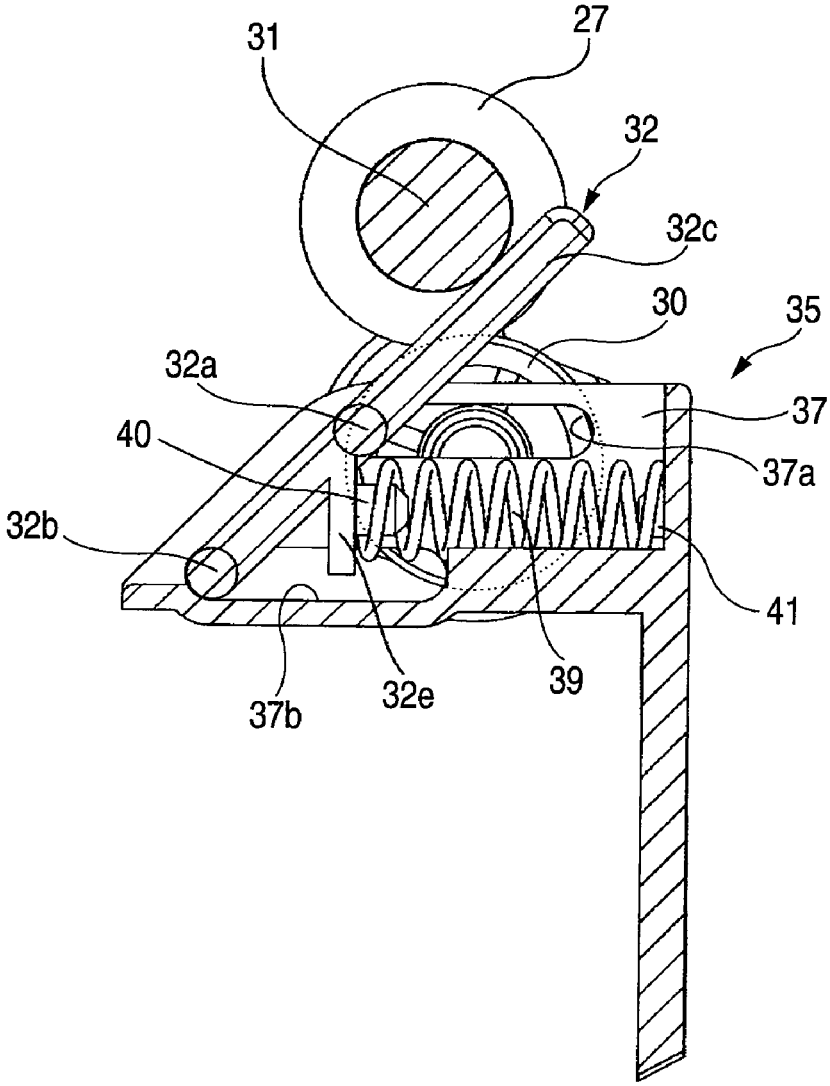
FIG. 6 is an enlarged view showing a sheet guiding mechanism according to the first exemplary embodiment.

FIGS. 3 and 4 are a sectional views taken along the line A-A in FIG. 2, and show one of the sheet lifting members 32 and the sheet discharging port 28. FIG. 3 shows the state at a moment that a leading end portion of a conveyed sheet 3 is discharged from the sheet discharging port 28 so as to contact with the sheet lifting members 32. FIG. 4 shows the state in which the leading end portion of the sheet 3 makes the sheet lifting members 32 move toward the discharge tray 29. In FIGS. 3 and 4, the left direction and the right direction are regarded as rear and front, respectively. FIG. 5 shows the shape of each sheet lifting member 32. FIG. 6 shows a sheet guiding mechanism 35 which guides the sheet lifting member 32 so that the sheet lifting member 32 can move.

The sheet lifting members 32 are provided at opposite end portions, in the width direction, of the sheet discharging port 28, respectively, so that the sheet lifting members 32 can move in a front-rear direction (direction of the arrow) as shown in FIG. 3. Specifically, each sheet lifting member 32 is supported by a guide member 37 (see also FIG. 6). The guide member 37 is located below the sheet discharging port 28 and provided in the discharge tray 29.

The guide member 37 has slits 37*a* and 37*b* which are long sideways in the front-rear direction (shown in more detail in FIG. 6). The slit 37*a* is located in an upper part of the guide member 37. The slit 37*b* is located in a lower part of the guide member 37. The slit 37*a* is located nearer to the discharge tray 29 side than the slit 37*b*. Another other guide member 37 (not shown) is also provided on the opposite side of the corresponding sheet lifting member 32. In other words, each sheet lifting member 32 is sandwiched between two guide members 37.

As shown in FIG. 5, each sheet lifting member 32 has a rectangular pad 32*c* with which a sheet 3 contacts. A rib 32*d* for guiding the sheet 3 is provided in a surface of the pad 32*c*. The pad 32*c* has a pair of columnar bosses 32*a* which protrude from positions near a central portion of the pad 32*c*, respectively. Another pair of columnar bosses 32*b* are provided on a lower side of the pad 32*c*. The pairs of bosses 32*a* and 32*b* are provided so as to protrude from the pad 32*c* to the left and right in a widthwise direction of the sheet lifting member 32. One of the bosses 32*a* and one of the bosses 32*b* are fit into the slits 37*a* and 37*b* of the guide member 37, respectively (see FIG. 3). The other boss 32*a* and the other boss 32*b* are fitted into the slits 37*a* and 37*b* provided in the other guide member 37 at the back of the sheet lifting member 32, respectively. In this manner, the bosses 32*a* and 32*b* slide in the slits 37*a* and 37*b*, respectively, so that the sheet lifting member 32 supported by the two guide members 37 can move in the front-rear direction.

As shown in FIG. 6, the sheet lifting member 32 is urged rearward (leftward in FIG. 6) by an urging unit 39. In the first exemplary embodiment, the urging unit 39 comprises a coiled spring. The urging unit 39 is supported by a nib portion 40 provided in a support plate 32*e* of the sheet lifting member 32 and a nib portion 41 provided in the guide member 37 and is contracted when the sheet lifting member 32 is pressed by a leading end portion of a sheet 3 while the sheet 3 is being discharged. That is, the urging unit 39 urges the sheet lifting member 32 rearward (leftward in FIG. 3) with an urging force smaller than an urging force with which the sheet 3 presses the sheet lifting member 32 frontward (rightward in FIG. 3). Accordingly, when the sheet 3 is being discharged, the sheet lifting member 32 is pressed by the leading end portion of the sheet 3 so as to be moved frontward. When the sheet 3 has been already discharged, that is, when there is no force for pressing the sheet lifting member 32, the sheet lifting member 32 is moved rearward by the urging force of the urging unit 39.

In FIGS. 3 and 6, the bosses 32*a* and 32*b* of the sheet lifting member 32 are disposed in rear ends (left ends in FIGS. 3 and 6) of the slits 37*a* and 37*b*, respectively, so that the sheet lifting member 32 keeps a posture such that an upper portion of the pad 32*c* is substantially disposed inward from an outer circumferential surface of the driving roller 27. The sheet lifting member 32 is disposed at a retraction position when the sheet lifting member 32 keeps the above-described posture.

Next, the behavior of the sheet lifting member 32 moved by discharge of a sheet 3 will be described. A sheet 3 with an image thermally fixed by the fixing unit 26 is conveyed to the driving rollers 27 and the driven rollers 30 via the conveyance path. A leading end portion of the sheet 3 discharged by the driving rollers 27 and the driven rollers 30 contact with the rib 32*d* of the pad 32*c* in a place near the central portion. The sheet lifting members 32 are pressed by the leading end portion of the discharged sheet 3 so as to be moved frontward (rightward in FIGS. 3 and 6). Then, the bosses 32*a* and 32*b* of the sheet lifting members 32 are moved so as to slide in the slits 37*a* and 37*b*, respectively.

The sheet 3 discharged by the driving rollers 27 and the driven rollers 30 becomes firm in the vicinities of nip portions between the driving rollers 27 and the driven rollers 30. The pads 32*c* of the sheet lifting members 32 are disposed near the nip portions where the sheet 3 becomes firm, therefore, the sheet lifting members 32 are pressed by the sheet 3 such that the sheet lifting members 32 move surely.

As shown in FIG. 4, the sheet lifting members 32 moved by the sheet 3 as described above stop when the bosses 32*a* and 32*b* come to protrusion positions of the front ends (right ends in FIGS. 3 and 6) of the slits 37*a* and 37*b*.

The force with which the leading end portion of the sheet 3 presses the sheet lifting members 32 acts as a force with which the sheet lifting members 32 move frontward, in a range from the retraction position in FIG. 3 to the protrusion position in FIG. 4. After the sheet lifting members 32 have been moved to the protrusion position by the leading end portion of the sheet 3, the leading end portion of the sheet 3 moves toward the upper portions of the pads 32*c* along the ribs 32*d* while pressing the sheet lifting members 32 (while keeping the state in which the sheet lifting members 32 are disposed in the protrusion position), so that the sheet 3 is discharged to the discharge tray 29.

The leading end portion of the discharged sheet 3 faces upward so that the leading end portion of the discharged sheet 3 does not come into contact with a trailing end portion of a sheet 3 discharged previously. That is, the sheet 3 is discharged by the sheet lifting members 32 in such a condition that the leading end portion of the sheet 3 is located in a position higher than the trailing end portion of a sheet 3 discharged previously. In this manner, the sheets 3 can be prevented from being disordered on the discharge tray 29 because the leading end portion of the currently discharged sheet 3 does not press the trailing end portion of the previously discharged sheet 3.

As shown in FIG. 2, the two sheet lifting members 32 are provided substantially in the opposite end portions of the body casing 2, respectively, in the sheet discharging port direction (widthwise direction of the sheet). In the case where, for example, a sheet 3 having its opposite end portions curled in the widthwise direction of the sheet is discharged, the sheet lifting members 32 provided in the opposite end portions of the body casing 2, respectively, discharge the sheet 3 while lifting up the curled portions of the sheet 3. In this manner, the currently discharged sheet 3 does not contact with the trailing end portion of the previously discharged sheet 3 when the sheet lifting members 32 are provided substantially in the opposite end portions, respectively, in the widthwise direction of the sheet 3. Thus, the sheets 3 can be prevented from being disordered on the discharge tray 29 because the leading end portion of the currently discharged sheet 3 does not press the trailing end portion of the previously discharged sheet 3.

After the sheet 3 has been discharged by the driving rollers 27 and the driven rollers 30, the sheet lifting members 32 move from the protrusion position to the retraction position shown in FIG. 3. Since the sheet lifting members 32 are urged rearward (leftward in FIG. 6) by the urging units 39 as shown in FIG. 6, the sheet lifting members 32 move to the retraction position when the force with which the leading end portion of the sheet 3 presses the sheet lifting members 32 is eliminated. Even if the trailing end portion of the sheet 3 cannot fall down to the discharge tray 29 but remains on the upper end portions of the sheet lifting members 32 after the sheet 3 has been discharged, the sheet lifting members 32 move from the protrusion position to the retraction position so that the trailing end portion of the sheet 3 falls down to the discharge tray 29 surely.

When the sheet lifting members 32 have returned from the protrusion position to the retraction position as described above, the upper portions of the pads 32*c* of the sheet lifting members 32 are substantially disposed inward relative to the outer circumferential surfaces of the driving rollers 27 again. When the sheet lifting members 32 move form the protrusion position to the retraction position in the condition that the trailing end portion of the discharged sheet 3 does not fall down to the discharge tray 29 but remains on the upper end portions of the sheet lifting members 32, even in such a case, the sheet lifting members 32 approach the rotary shaft 31 compared with the outer circumferential surfaces of the driving rollers 27 so that the trailing end portion of the sheet 3 contacts with the outer circumferences of the driving rollers 27 to thereby be pressed out toward the discharge tray 29. Accordingly, the sheet 3 can always be discharged onto the discharge tray 29 because the trailing end portion of the sheet 3 is prevented from remaining on the upper end portions of the pads 32*c* of the sheet lifting members 32.

Second Exemplary Embodiment

Figure 7:
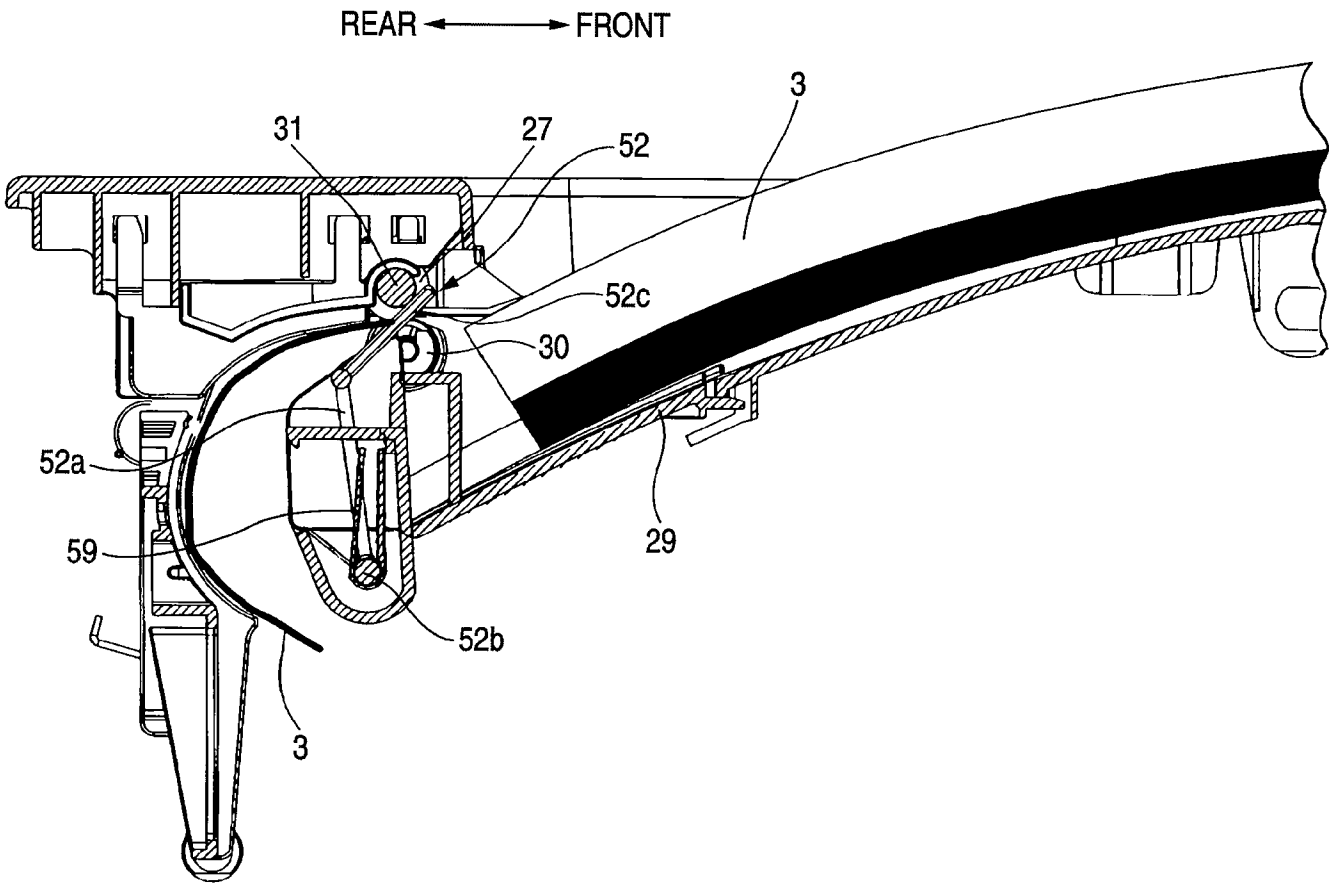
FIG. 7 is a view of an image forming apparatus according to a second exemplary embodiment of the present invention where the view shows a state in which a sheet lifting member is disposed in a retraction position.
Figure 8:
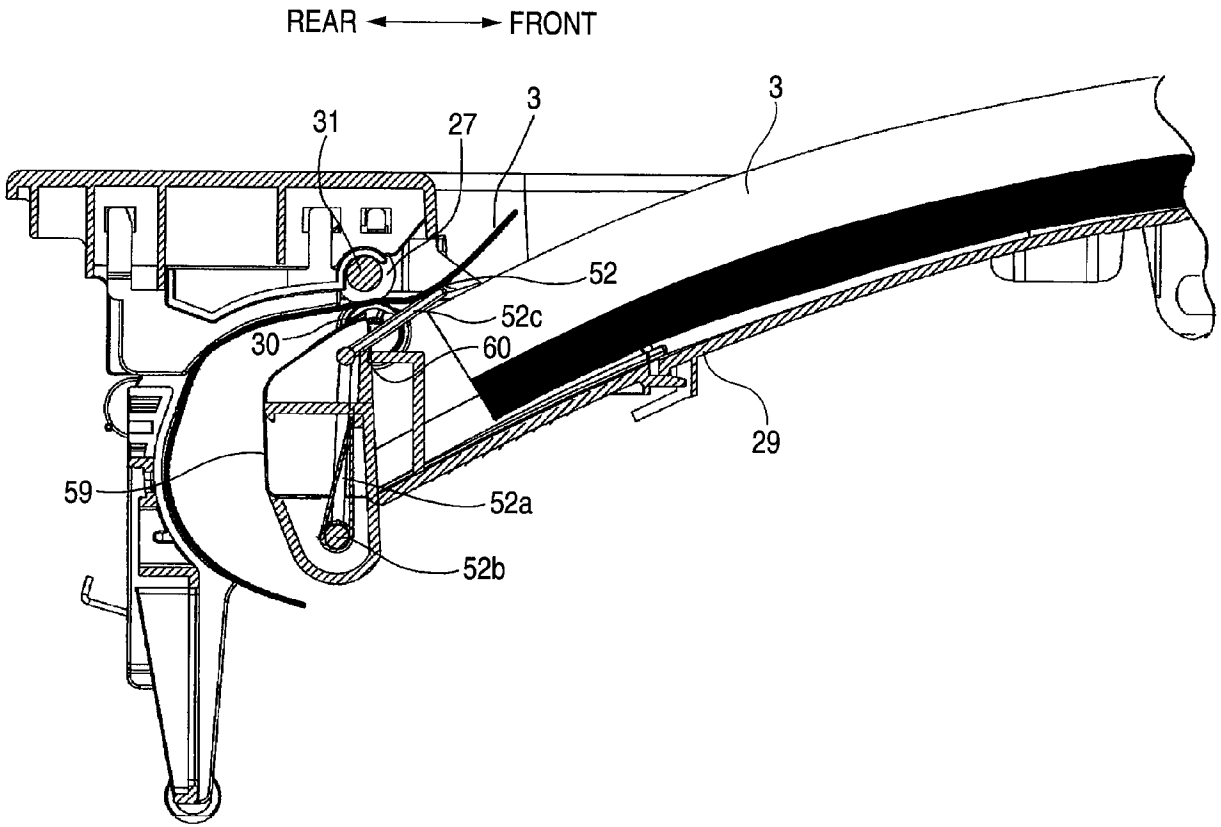
FIG. 8 is a view showing a state in which the sheet lifting member is disposed in a protrusion position according to the second exemplary embodiment.
Figure 9:
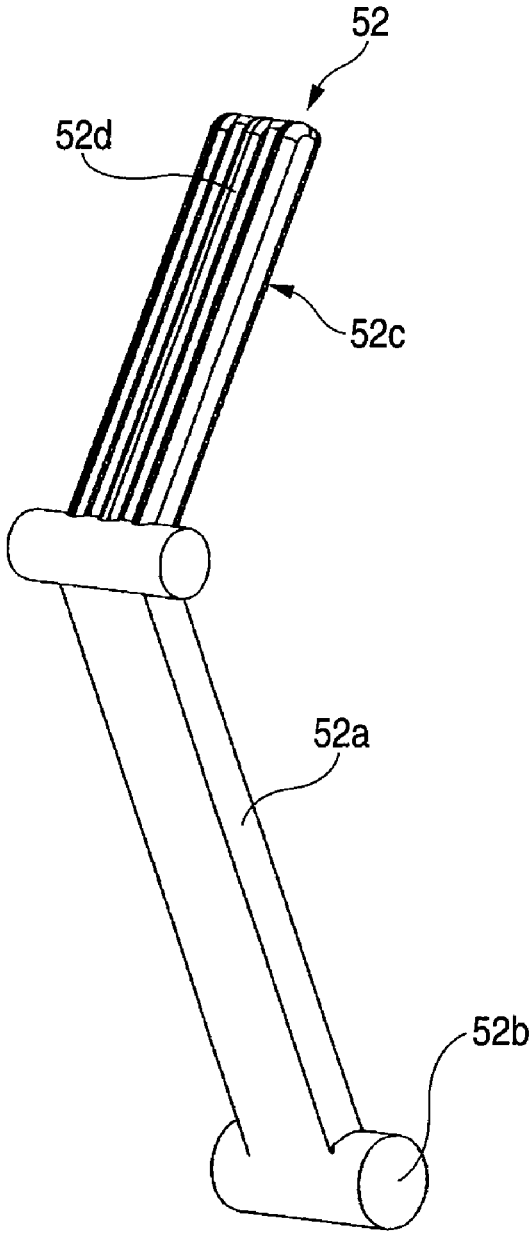
FIG. 9 is an enlarged perspective view of the sheet lifting member according to the second exemplary embodiment.
Figure 10:
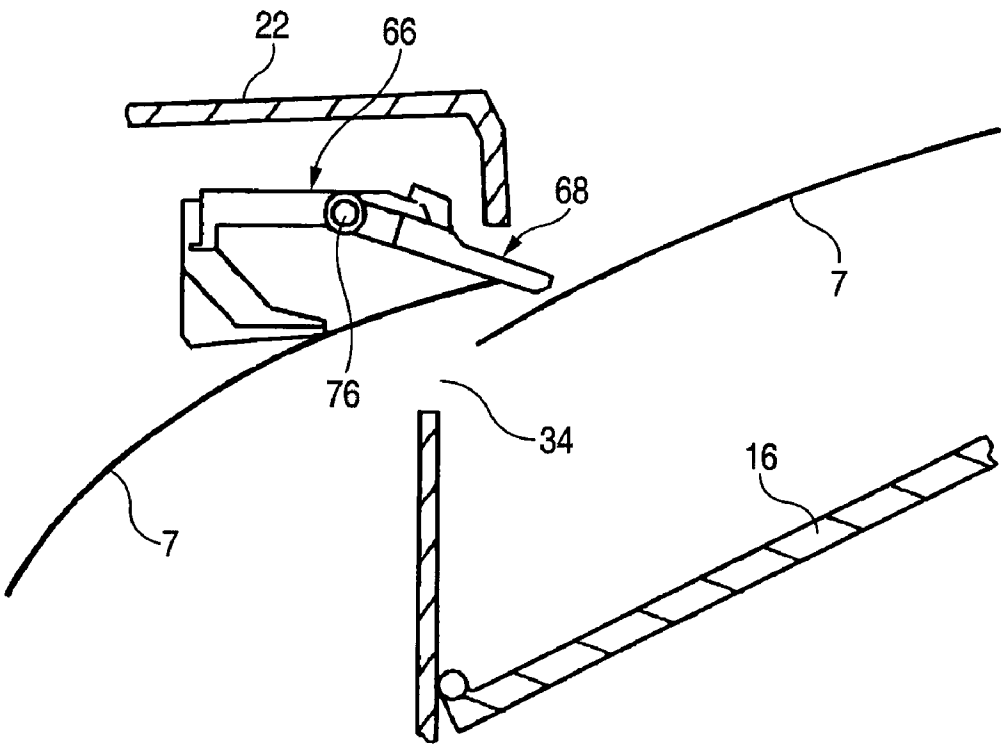
FIG. 10 PRIOR ART
FIG. 10 is a view showing a related art sheet discharging device.

FIGS. 7, 8 and 9 show a second exemplary embodiment of the present invention. The overall configuration of the laser printer 1 and the sheet discharging port 28, etc. are the same as those in the first exemplary embodiment.

FIG. 7 is a view showing one of sheet lifting members 52 according to the second exemplary embodiment of the present invention. FIG. 7 shows a state in which a leading end portion of a conveyed sheet 3 is discharged from the sheet discharging port 28 and contacts with the sheet lifting members 52. FIG. 8 shows a situation in which the leading end portion of the sheet 3 moves the sheet lifting members 52 toward the discharge tray 29. In FIGS. 7 and 8, the left and right directions are regarded as rear and front, respectively. FIG. 9 is a perspective view showing the shape of each sheet lifting member 52. As in the first exemplary embodiment, the sheet lifting members 52 are provided at opposite sides in the width direction of the sheet.

As shown in FIG. 9, each sheet lifting member 52 has a rectangular pad 52*c*, a connection portion 52*a*, and a rotary center shaft 52*b*. A sheet 3 makes contact with the pad 52*c*. The connection portion 52*a* is connected to a lower side of the pad 52*c* so that a combination of the connection portion 52*a* and the pad 52*c* is doglegged. The rotary center shaft 52*b* is provided in a lower side of the connection portion 52*a*. The sheet lifting member 52 is rotated around the rotary center shaft 52*b*. A rib 52*d* for guiding the sheet 3 is provided in a surface of the pad 52*c*.

In FIG. 7, each sheet lifting member 52 is urged counterclockwise by an urging unit 59. In this exemplary embodiment, the urging unit 59 comprises a torque spring provided in the rotary center shaft 52*b*, so that the sheet lifting member 52 keeps such a condition that the pad 52*c* contacts with the rotary shaft 31. This position is denoted as a retraction position.

Next, the behavior of the sheet lifting members 52 moved in accordance with discharge of a sheet 3 will be described. The sheet 3 with an image thermally fixed by the fixing unit 26 is conveyed to the driving rollers 27 and the driven rollers 30 via a conveyance path. A leading end portion of the sheet 3 discharged by the driving rollers 27 and the driven rollers 30 contacts with substantially central portions of the ribs 52*d* of the pads 52*c*. The sheet lifting members 52 are pressed by the leading end portion of the discharged sheet 3 so as to be rotated clockwise around the rotary center shaft 52*b*.

When the sheet lifting members 52 moved by the sheet 3 come to such a position that the sheet lifting members 52 protrude from the sheet discharging port 28 toward the discharge tray 29 as shown in FIG. 8, the sheet lifting members 52 contact with a stoppage portion 60 which is a part of the discharge tray 29, and stop. This position is denoted as a protrusion position.

The force with which the leading end portion of the sheet 3 presses the sheet lifting members 52 acts as a force to rotate the sheet lifting members 52 frontward in a range from the retraction position in FIG. 7 to the protrusion position in FIG. 8. After the sheet lifting members 52 have been moved to the protrusion position by the leading end portion of the sheet 3, the leading end portion of the sheet 3 moves along the ribs 52*d* toward upper portions of the pads 52*c* while pressing the sheet lifting members 52 (i.e., while keeping the condition that the sheet lifting members 52 are disposed in the protrusion position). The sheet 3 is discharged onto the discharge tray 29. The leading end portion of the discharged sheet 3 faces upward, so that the leading end portion of the discharged sheet 3 does not come into contact with a trailing end portion of a previously discharged sheet 3.

When the sheet 3 has been already discharged by the driving rollers 27 and the driven rollers 30, the sheet lifting members 52 return from the protrusion position to the retraction position shown in FIG. 7. Since the sheet lifting members 52 are urged counterclockwise by the urging units 59, the sheet lifting members 52 are moved to the retraction position when the force with which the leading end portion of the sheet 3 presses the sheet lifting members 52 is eliminated. The urging units 59 are provided as described above, therefore, the sheet lifting members 52 can more easily be rotated clockwise by the urging unit 59, compared with the case where each sheet lifting member 52 is rotated clockwise by its own weight.

The first and second exemplary embodiments have been described in the case where the sheet lifting members 32 or 52 are provided in the opposite end portions in the width direction of the sheet discharging port 28, respectively. It is advantageous to apply the sheet lifting members in a position corresponding to a curl of a sheet. Accordingly, the sheet lifting members 32 or 52 may be provided in accordance with the shape of a curled sheet 3 when the shape of the curled sheet 3 is different. Additionally, while the above described exemplary embodiments included two sheet lifting members, the number of sheet lifting members may be one, or three or more.

It is also possible to dispose a light-emitting portion and a light-receiving portion of a photo interrupter across part of the sheet lifting members 32 or 52 when the sheet lifting members 32 or 52 are disposed in the protrusion position. In this configuration, the sheet lifting members 32 or 52 can function also as detecting units for detecting a sheet 3.

According to the above exemplary embodiments, the sheet lifting members (32, 52) discharge the sheet (3) from the sheet discharging port (28) to the discharge tray (29) while lifting up the sheet (3) when the sheet lifting members (32, 52) are located in the protrusion position because a leading end portion of the sheet (3) contacts with the sheet lifting members (32, 52) to thereby move the sheet lifting members (32, 52) from the retraction position to the protrusion position. Then, the sheet lifting members (32, 52) return to the retraction position when the sheet (3) has been discharged from the sheet discharging port (28).

Thus, the sheet (3) is lifted up by the sheet lifting members (32, 52) when the sheet lifting members (32, 52) are located in the protrusion position. That is, the leading end portion of the currently discharged sheet (3) is lifted up by the sheet lifting members (32, 52) to a position higher than a trailing end portion of a previously discharged sheet (3), so that the currently discharged sheet (3) is discharged from this position. Accordingly, the sheets (3) can be prevented from being disordered on the discharge tray (29) because the leading end portion of the currently discharged sheet (3) does not press the trailing end portion of the previously discharged sheet (3).

The sheet lifting members (32, 52) are moved from the retraction position to the protrusion position by a pressing force of the sheet (3) discharged from the sheet discharging port (28). Accordingly, the cost is low because a drive source for moving the sheet lifting members (32, 52) and a control unit for controlling the drive source is not used.

After the sheet (3) is discharged from the sheet discharging port (28), the trailing end portion of the sheet falls down to the discharge tray (29) in accordance with the movement of the sheet lifting members (32, 52) from the protrusion position to the retraction position. Thus, the discharged sheet (3) is well-ordered on the discharge tray (29).

According to the above described exemplary embodiments, the sheet lifting members (32, 52) are located in the retraction position by urging units (39, 59) by which the sheet lifting members (32, 52) are urged to move from the protrusion position toward the retraction position.

The urging units (39, 59) are provided. Therefore, the sheet lifting members (32, 52) may be moved accurately, compared with the case where each sheet lifting member (32, 52) moves from the protrusion position to the retraction position, for example, by its own weight.

According to the above exemplary embodiments, the sheet lifting members (32, 52) are provided substantially in at least opposite end portions of the sheet discharging port (28), respectively, in a widthwise direction of the sheet.

When widthwise opposite end portions of the previously discharged sheet (3) are curled upward, the currently discharged sheet does not contact with the trailing end portion of the previously discharged sheet (3) when the sheet lifting members (32, 52) are provided in at least two places near the widthwise opposite end portions of the sheet. Thus, the sheets (3) can be prevented from being disordered on the discharge tray (29) because the leading end portion of the currently discharged sheet (3) does not press the trailing end portion of the previously discharged sheet (3).

According to the above exemplary embodiments, the sheet discharging port (29) has driving rollers (27) driven to rotate in order to discharge the sheet (3) to the discharge tray (29), and driven rollers (30) driven to rotate by the driving rollers (27) while hitting against the driving rollers (27). The sheet lifting members (32, 52) are provided near nip portions between the driving rollers (27) and the driven rollers (30).

The discharged sheet (3) becomes firm in the nip portions between the driving rollers (27) and the driven rollers (30). The sheet lifting members (32, 52) are disposed near the nip portions where the sheet becomes firm, and the sheet lifting members (32, 52) are pressed by the sheet (3) to thereby be moved accurately.

According to the above exemplary embodiments, the driving rollers (27) are provided at intervals on a rotary shaft (31) which rotate the driving rollers (27), in the widthwise direction of the sheet. The sheet lifting members (32, 52) are located between the rotary shaft (31) and outer circumferential surfaces of the driving rollers (27) in view from the widthwise direction of the sheet (3) when the sheet lifting members (32, 52) are disposed in the retraction position.

After the sheet (3) is discharged from the sheet discharging port (28), the sheet lifting members (32, 52) move from the protrusion position to the retraction position. The trailing end portion of the sheet (3) falls down onto the discharge tray (29) in accordance with the movement of the sheet lifting members (32, 52). When the trailing end portion of the sheet (3) cannot fall down to the discharge tray (29) but remains on upper portions of the sheet lifting members (32, 52), the sheet (3) can fall down to the discharge tray (29) surely because the trailing end portion of the sheet (3) hits against the outer circumferential surfaces of the driving rollers (27) when the sheet lifting members (32, 52) are moved to the retraction position.

The sheet lifting members are provided as part of an image forming apparatus. For example, according the another exemplary embodiment of the present invention, there is provided an image forming apparatus including a sheet discharging device according to one of the above exemplary embodiments, and an image forming unit which forms an image on the sheet (3), wherein the sheet (3) with the image formed by the image forming unit is discharged by the sheet discharging device.

According to the above image forming apparatus, the image forming apparatus has the same effects as above exemplary embodiments.

While the present invention has been shown and described with reference to certain exemplary embodiments thereof, it will be understand by those skilled in the art that various changes in form and details maybe made therein without departing from the spirit and scope of the invention as defined by the appended claims.

What is claimed is:

1. A sheet discharging device comprising:

a sheet discharging port from which a sheet is discharged;

a sheet discharging tray which is provided correspondingly to the sheet discharging port, the sheet discharged from the sheet discharging port being stacked on the sheet discharging tray;

a plurality of sheet lifting members provided so as to be moveable between a retraction position in which the sheet lifting members are located in the sheet discharging port and a protrusion position in which the sheet lifting members protrude from the sheet discharging port toward the sheet discharging tray; and two guide members provided with each sheet lifting member, one guide member provided on either side of the sheet lifting member such that the corresponding sheet lifting member is slidable in a direction of discharge of the sheet, wherein when a leading end portion of the sheet contacts with the sheet lifting members, the sheet lifting members move from the retraction position to the protrusion position, the sheet lifting members stay at the protrusion position and lift up the sheet while the sheet is discharged from the sheet discharging port to the sheet discharge tray, and the sheet lifting members return to the retraction position when the sheet has been discharged from the sheet discharging port.

2. A sheet discharging device according to claim 1, further comprising:

a plurality of urging units that urge the sheet lifting members to move from the protrusion position toward the retraction position.

3. A sheet discharging device according to claim 1, wherein the sheet lifting members are provided at opposite end portions of the sheet discharging port, respectively, in a widthwise direction of the sheet.

4. A sheet discharging device according to claim 1, wherein the sheet discharging port comprises:

a plurality of driving rollers driven to rotate in order to discharge the sheet to the sheet discharging tray, and a plurality of driven rollers, which correspond to the driving rollers and are driven to rotate by the rotation of the driving rollers; and wherein the sheet lifting members are provided corresponding to positions of nip portions between the driving rollers and the driven rollers.

5. A sheet discharging device according to claim 4, wherein the driving rollers are provided at intervals on a rotary shaft that rotates the driving rollers, in the widthwise direction of the sheet; and the sheet lifting members are located between the rotary shaft and outer circumferential surfaces of the driving rollers as viewed from the widthwise direction of the sheet when the sheet lifting members are disposed in the retraction position.

6. An image forming apparatus comprising:

an image forming unit that forms an image on a sheet;

a sheet discharging device comprising:

a sheet discharging port from which the sheet is discharged;

a sheet discharging tray which is provided correspondingly to the sheet discharging port, the sheet discharged from the sheet discharging port being stacked on the sheet discharging tray;

a plurality of sheet lifting members provided so as to be moveable between a retraction position in which the sheet lifting members are located in the sheet discharging port and a protrusion position in which the sheet lifting members protrude from the sheet discharging port toward the sheet discharging tray; and two guide members provided with each sheet lifting member, one guide member provided on either side of the sheet lifting member such that the corresponding sheet lifting member is slidable in a direction of discharge of the sheet.

wherein when a leading end portion of the sheet contacts with the sheet lifting members, the sheet lifting members move from the retraction position to the protrusion position, the sheet lifting members stay at the protrusion position and lift up the sheet while the sheet is discharged from the sheet discharging port to the sheet discharge tray, and the sheet lifting members return to the retraction position when the sheet has been discharged from the sheet discharging port.

7. An image forming apparatus comprising:

an image forming unit that forms an image on a sheet;

a plurality of discharge rollers which discharge the sheet from an interior of the image forming apparatus;

a sheet discharging tray which receives the sheet from the discharge rollers;

at least one sheet lifting member that deflects the sheet which is discharged by the discharge rollers upward with respect to a discharge path of the sheet; and two guide members provided with each sheet lifting member, one guide member provided on either side of the sheet lifting member such that the corresponding sheet lifting member is slidable in a direction of discharge of the sheet.

8. The image forming apparatus according to claim 7 further comprising:

an urging member that urges the sheet lifting member towards the discharge rollers.

9. The image forming apparatus according to claim 8, wherein the urging member is a coil spring.

10. The image forming apparatus according to claim 7, wherein each sheet lifting member comprises:

a pad that deflects the sheet;

a connection portion, one end of which is attached to the pad at an angle, the other end of which is rotatably connected to the image forming apparatus.

11. The image forming apparatus according to claim 10, further comprising an urging member that urges the pad of the sheet lifting member towards the discharge rollers.

12. The image forming apparatus according to claim 11, wherein the urging member comprises a leaf spring.

* * * * *